US007199334B2

(12) United States Patent
Friedman et al.

(10) Patent No.: US 7,199,334 B2
(45) Date of Patent: Apr. 3, 2007

(54) APPARATUS AND METHOD FOR HEATING AND TRANSFERRING A WORKPIECE PRIOR TO FORMING

(75) Inventors: Peter Friedman, Ann Arbor, MI (US); Richard Allor, Livonia, MI (US); George Luckey, Jr., Dearborn, MI (US); Warren Copple, Trenton, MI (US)

(73) Assignee: Ford Global Technologies, LLC., Dearborn, MI (US)

( * ) Notice: Subject to any disclaimer, the term of this patent is extended or adjusted under 35 U.S.C. 154(b) by 213 days.

(21) Appl. No.: 11/000,186

(22) Filed: Nov. 30, 2004

(65) Prior Publication Data

US 2006/0237420 A1 Oct. 26, 2006

(51) Int. Cl.

| | |
|---|---|
| ***H05B 3/30*** | (2006.01) |
| ***B21D 26/02*** | (2006.01) |
| ***B21D 37/14*** | (2006.01) |
| ***B21D 37/16*** | (2006.01) |

(52) U.S. Cl. ..... 219/385; 219/154; 219/158; 219/245; 219/246; 219/255; 219/259; 72/361

(58) Field of Classification Search ..... None
See application file for complete search history.

(56) References Cited

U.S. PATENT DOCUMENTS

| | | | | |
|---|---|---|---|---|
| 2,789,204 | A * | 4/1957 | Kilpatrick et al. | 219/154 |
| 3,868,209 | A * | 2/1975 | Howell | 425/388 |
| 4,079,232 | A * | 3/1978 | Brokoff et al. | 219/154 |
| 4,888,973 | A * | 12/1989 | Comley | 72/342.92 |
| 5,113,681 | A * | 5/1992 | Guesnon et al. | 72/364 |
| 6,749,418 | B2 * | 6/2004 | Muirhead | 425/388 |
| 6,890,394 | B2 * | 5/2005 | Carsley et al. | 148/564 |

FOREIGN PATENT DOCUMENTS

JP 02303635 A * 12/1990

* cited by examiner

*Primary Examiner*—Joseph Pelham
(74) *Attorney, Agent, or Firm*—Tung & Associates; Raymond L. Coppiellie

(57) ABSTRACT

An apparatus and method for heating and transferring a workpiece to a forming press for superplastic forming. The apparatus includes a heater assembly, having upper and lower heated platens, mounted to a frame. The heater assembly heats the workpiece to a predetermined temperature. A shuttle assembly operates to remove the heated workpiece from the heater assembly and transfer it to the forming press for forming.

20 Claims, 10 Drawing Sheets

APPARATUS AND METHOD FOR HEATING AND TRANSFERRING A WORKPIECE PRIOR TO FORMING

CROSS-REFERENCE TO RELATED APPLICATIONS

Not Applicable.

BACKGROUND OF THE INVENTION

1. Field of the Invention

The present invention relates generally to an apparatus and method for heating a workpiece and transferring the heated workpiece to a forming press; and, more specifically, to an apparatus and method to preheat a workpiece and transfer the preheated workpiece to a forming die wherein the workpiece undergoes a superplastic forming process.

2. Description of Related Art

Superplastic forming (SPF) takes advantage of a material's superplasticity or ability to be strained past its rupture point under certain elevated temperature conditions. Superplasticity in metals is defined by very high tensile elongations, ranging from two hundred to several thousand percent. Superplasticity is the ability of certain materials to undergo extreme elongation at the proper temperature and strain rate. SPF is a process used to produce parts that are difficult to form using conventional fabrication techniques.

SPF typically includes the steps of heating a sheet of material to a point of superplasticity, clamping the material within a sealed die and then using gas pressure applied to one side of the sheet of material to force the material to stretch and take the shape of a forming surface located in the die cavity. At higher temperatures, superplastic materials may stretch several times their initial length without breaking. Controlling the gas pressure during the forming process controls the deformation rate of the material and maintains superplasticity at the elevated temperature.

Typical SPF applications, while having advantages over conventional stamping techniques including increased forming strains, reduced spring back and low tooling costs, have disadvantages in that they are limited to low volumes as they have relatively long forming cycle times. Specifically, a conventional SPF process used to manufacture a complex part can require a forming cycle time as high as 30 minutes.

Reduced cycle times are necessary in order to use SPF for the high production requirements of the automotive industry. Prior art SPF forming processes typically start with loading a room temperature metal sheet or blank into a heated forming die located in a press assembly used to open and close the forming die. The heated forming die operates to heat the metal sheet, typically by a combination of conduction and convection, to a forming temperature. This step automatically builds a certain amount of the dwell time into the process before the forming cycle begins. Accordingly, using the forming die to heat the metal sheet further increases the overall cycle time used to manufacture a part. Further, heating the metal sheet with the forming die is not as efficient as other heating methods.

An apparatus and method for loading a preheated workpiece into a forming die of a superplastic forming apparatus can significantly reduce overall cycle times by using the time the workpiece spends in the forming die for forming, not waiting for the workpiece to reach suitable SPF forming temperatures. Accordingly, such an apparatus and method is advantageous in that it helps to increase the production volumes obtained using a superplastic forming manufacturing process.

SUMMARY OF THE INVENTION

The present invention is an apparatus for heating and transferring a workpiece into a forming press for superplastic forming. The apparatus includes a frame formed of a plurality of upright leg members interconnected by side support members. A heater assembly, including upper and lower heated platens, is mounted or secured to the frame. The heater assembly operates to heat a workpiece placed between the upper and lower heated platens. When the workpiece reaches a predetermined temperature, a shuttle assembly, including a transfer mechanism and a carrier mechanism, removes the heated workpiece from the heater assembly and transfers it to the forming press for forming.

One advantage of the present invention is that it preheats a workpiece to a predetermined temperature. In addition, the present invention delivers the preheated workpiece to a forming press and places the preheated workpiece in a forming die whereby the forming process can begin immediately.

DETAILED DESCRIPTION OF THE PREFERRED EMBODIMENTS

Figure 1:
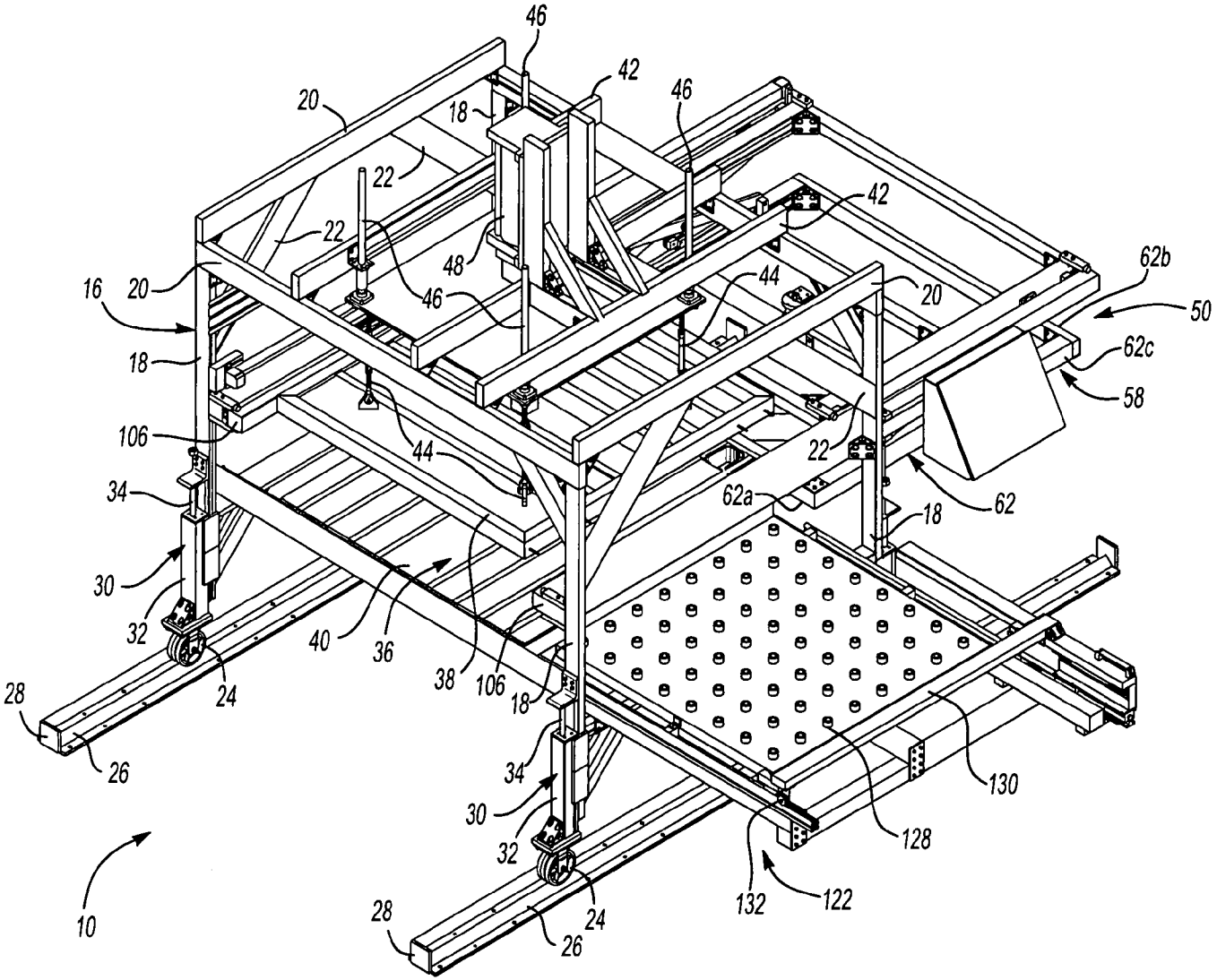
FIG. 1 is a perspective view of an apparatus according to the present invention.
Figure 2:
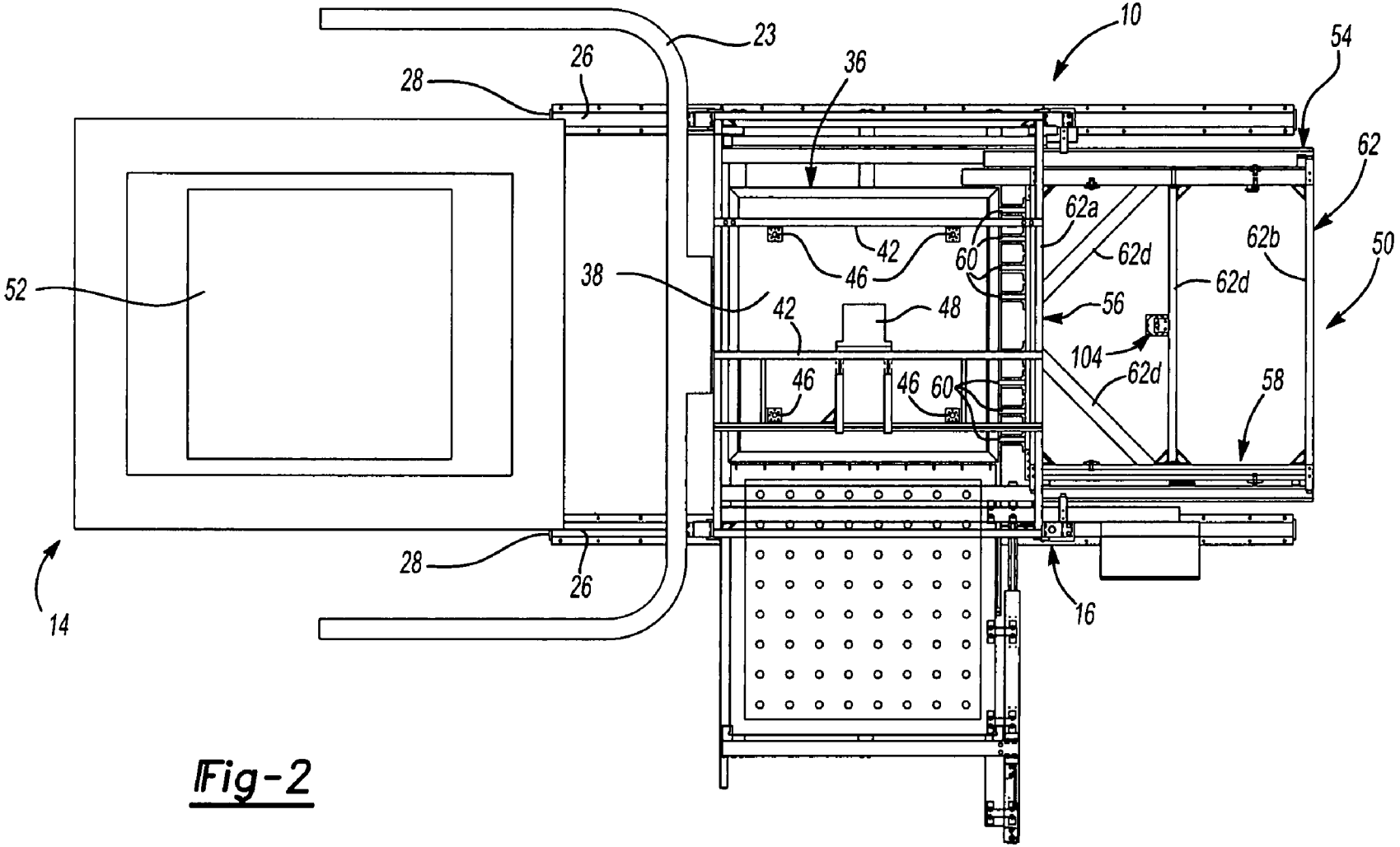
FIG. 2 is a top view of the apparatus of FIG. 1.
Figure 3:
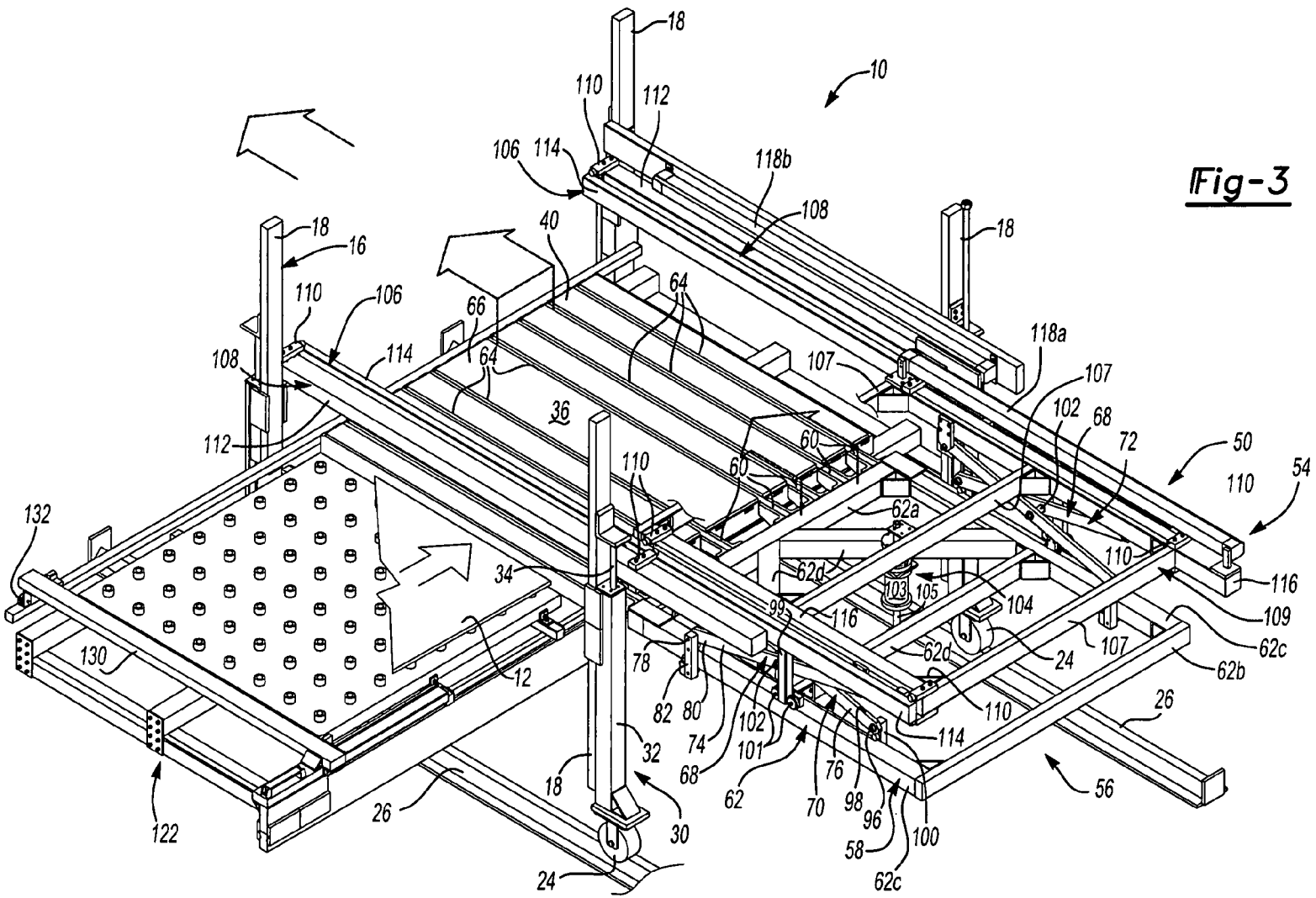
FIG. 3 is a partial perspective view of the apparatus of FIG. 1 with portions removed for clarity.

FIGS. 1–3 show one embodiment of an apparatus, seen generally at 10, for heating and transferring a workpiece 12. The apparatus 10 heats the workpiece 12, typically a metal blank, to a temperature suitable for superplastic forming. The apparatus 10 then transfers the heated workpiece 12 to a press assembly, seen schematically at 14. The press assembly 14, used in conjunction with a superplastic forming process, typically includes a superplastic forming die 52. After placing the workpiece 12 in the forming die 52, the forming die 52 is closed and gas pressure applied to one side of the workpiece 12 forces the workpiece against a forming surface of the forming die 52 to complete the superplastic forming process. The foregoing description of a superplastic forming process notwithstanding, the apparatus 10 is suitable for use with any process or assembly requiring a heated workpiece.

The apparatus 10 includes a frame assembly 16 including a plurality of upright members 18 interconnected by side members 20. In addition, the frame assembly 16 may include a plurality of brace members 22 interconnecting the upright members 18 with the side members 20. The press assembly 14 typically includes a door 23, seen schematically in FIG. 2, which opens to allow access to the forming die 52. Closing the door 23 during the forming process helps maintain the forming die 52 at a temperature suitable for superplastic forming. The frame assembly 16 includes a plurality of roller members or wheels 24 secured to the lower ends of the upright members 18. The wheels 24 enable the frame assembly 16 to move along a track 26 until they engage a stop 28 located on or at the end of the track 26. An actuator, seen generally at 30, including a cylinder 32 and rod 34, adjustably secures the wheels 24 to the lower ends of the upright members 18. Accordingly, the respective actuators 30 located on each of the upright members 18 operate to raise and lower the frame assembly 16 with respect to the track 26. The actuators 30 also provide a rough adjustment to properly position the height of the apparatus 10 with respect to that of the press assembly 14.

The apparatus 10 utilizes a heater assembly, such as a contact heater, seen generally at 36, for heating the workpiece 12 by conduction. A convection type heater assembly may also be used. The contact heater 36 includes a lower heated platen 40 connected to the frame assembly 16, particularly the upright members 18. Typically, the lower heated platen 40 remains stationary. Supported below a plurality of cross members 42 located on the top of the frame assembly 16 is an upper heated platen 38. A plurality of guide rods 44 extending upwardly from the upper heated platen 38 are received in guide tubes 46 connected to the cross members 42. An actuator 48, supported on the top of the frame assembly 16, engages the upper heated platen 38 and is operative to move the upper heated platen 38 reciprocally relative to the lower heated platen 40.

The contact heater 36 sandwiches the workpiece 12 between the upper heated platen 38 and the lower heated platen 40. The upper heated platen 38 generates a normal or clamping force on the workpiece 12, which insures that the workpiece 12 stays in complete contact with both the upper and lower heated platens 38, 40. In the alternative, the upper heated platen 38 can be set to stop just above the workpiece 12. While full contact between both the upper and lower heated platens 38, 40 offers the fastest heating time, there are advantages to stopping the upper heated platen 38 from contacting the workpiece 12. By stopping the upper heated platen 38 just above the workpiece 12, the workpiece 12 can freely expand which helps minimize scratching of the workpiece 12. In this scenario, the combination of conduction and convection heating is adequate to heat the workpiece 12 to superplastic forming temperatures within sufficient cycle or forming times.

The upper and lower heated platens 38, 40 are typically constructed of steel plate, as steel has a large thermal capacity which helps retain heat during cycling of the contact heater 36. Both the upper and lower heated platens 38, 40 are typically insulated on all but the contact surfaces. Both the upper and lower heated platens 38, 40 use cartridge heaters depending on the requirements. Steel is a good heat capacitor and can be machined to insure flatness, however, both the upper and lower heated platens 38, 40 can be made from other materials.

The apparatus 10 further includes a shuttle assembly, seen generally at 50. The shuttle assembly 50 moves the workpiece 12 from a first position, wherein the workpiece 12 is located in and heated by the heater assembly or contact heater 36, to a second position, wherein the workpiece 12 is deposited in a forming die 52 located in the press assembly 14. The shuttle assembly 50 includes a transfer mechanism, seen generally at 54, and a carrier mechanism, seen generally at 56.

The carrier mechanism 56 includes a support member 58 that engages the workpiece 12 and carries the workpiece 12 from the contact heater 36 to the forming die 52. In the preferred embodiment, the support member 58 includes a plurality of fork-like tines 60 extending outward from a support frame 62. The tines 60 fit within a plurality of grooves or channels 64 located in the upper surface 66 of the lower heated platen 40. The tines 60 are located in the grooves or channels 64 while the workpiece 12 is heated. Once the workpiece 12 reaches a predetermined temperature or heats for a suitable time, raising the upper heated platen 38 reveals the workpiece 12. Lifting the support frame 62 upward raises the tines 60 out of the grooves or channels 64 in the lower heated platen 40 and correspondingly lifts the workpiece 12 off the upper surface 66 of the lower heated platen 40.

The support member 58 includes a plurality of tines 60 attached to a support frame 62, shown herein as a rectangular shaped member formed by front 62*a*, back 62*b* and side 62*c* members interconnected by brace or cross members 62*d*. Other support members of various configurations can be used provided the configuration of grooves or channels 64 located in the lower heated platen 40 have a complementary configuration. In addition, the preferred embodiment shows the support member 58 disposed in the lower heated platen 40 during the heating process. It is within the scope of the present invention to raise the upper heated platen 40, once the workpiece 12 has reached a predetermined temperature or heats for a predetermined time, and then insert the support member 58 to lift the workpiece 12 off the lower heated platen 38. The support member 58 may also slide under the workpiece 12 and over the upper surface 66 of the lower heated platen 40 to lift the workpiece 12 off the lower heated platen 40. The tines 60 may include a plurality of interconnected apertures 61. The apertures 61 each connect to a vacuum source, which draws a vacuum and correspondingly provides suction to help keep the workpiece 12 on the tines 60.

The carrier mechanism 56 further includes a lift mechanism, seen generally at 68, coupled to the support member 58. The lift mechanism 68 operates to raise and lower the support member 58. In the embodiment disclosed herein, the lift mechanism 68 includes first and second scissors lift linkage 70, 72. The first scissors lift linkage 70 includes first and second link members 74, 76. A pin 78 pivotally connects a first end 80 of the first link member 74 to a bracket 82 slidably attached to the support frame 62. A pin 84 pivotally connects a second end 86 of the first link member 74 to a bracket 88 slidably attached to the transfer mechanism 54. Similarly, a pin 90 pivotally connects a first end 92 of the second link member 76 to a bracket 94 slidably attached to the transfer mechanism 54. A pin 96 pivotally connects a second end 98 of the second link member 76 to a bracket 100 slidably attached to the support frame 62.

The first link member 74 and second link member 76 are pivotally coupled to one another by a pin 102 such that the first link member 74 and second link member 76 can rotate relative to one another. The second scissor lift linkage 72 is similar to and operates in the same manner as the first scissor lift linkage 70 set forth above. Accordingly, both the first scissor lift linkage 70 and the second scissor lift linkage 72 cooperate to raise and lower the carrier mechanism 56.

A lift actuator 104 secured to the support member 58 and the transfer mechanism 54 provides the power to raise and lower the support member 58 with respect to the transfer mechanism 54. The actuator 104 includes a power cylinder 103 attached to a crossbar 107 of the transfer mechanism 54 and a rod 105 attached to a brace or cross member 62*d* of the support frame 62 of the support member 58. Accordingly, reciprocal movement of the rod 105 within the power cylinder 103 correspondingly raises or lowers the support frame 62, and corresponding tines 60, with respect to the transfer mechanism 54. A guide rod 99 attached to and extending from the transfer mechanism 54 engages a pair of rollers 101 attached to the support frame 62 of the support member 58.

While the lift mechanism 68 shown herein includes first and second scissor lift linkages 70, 72 used to raise and lower the carrier mechanism 56, other types of lift mechanisms suitable for lifting the tines 60 and correspondingly the workpiece 12 are within the scope of the present invention. For instance, hydraulics, screw assemblies, pneumatics, or other mechanical mechanisms such as gears or levers along with the various power sources or lift motors may also be used.

Figure 6:
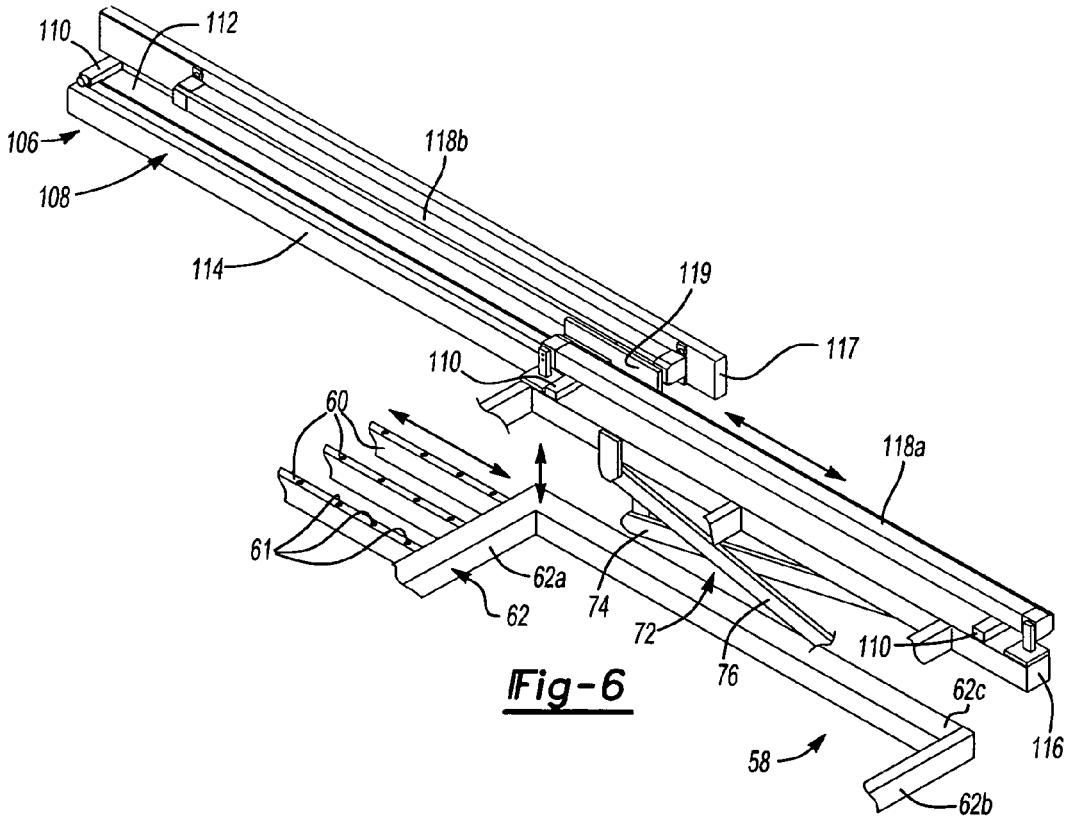
FIG. 6 is a partial perspective view of a transfer mechanism according to the present invention.

As shown in FIGS. 3 and 6, the lift mechanism 68 connects to the transfer mechanism 54. The transfer mechanism 54 includes a plurality of longitudinally extending arm members 106. In the preferred embodiment, the arm members 106 include a plurality of elongated rail members, seen generally at 108, slidably supported in a telescopic relationship on one another by a plurality of rollers 110. While disclosed herein as external, the rollers 110 could be internal in that they engage an inner surface or track of the elongated rail members 108. As shown in FIG. 3, secured to the upright posts or members 18 of the frame assembly 16 is a first rail member 112. Second and third rail members 114, 116 slidably connect to one another such that the second rail member 114 slides on the first rail member 112 and the third rail member 116 slides on the second rail member 114. Accordingly, the arm members 106 extend outwardly in a cantilever fashion from the frame assembly 16. The third rail members 116 are attached or connected to one another by a plurality of cross members 107. Accordingly, the third rail members 116 and cross members 107 form a rectangular frame 109 that is slidably mounted, by rollers 110, on the second rail member 114.

FIG. 6 shows actuators 118*a* and 118*b* used to extend and retract the arms 106. The first actuator 118*a* is secured to the third rail member 116. The actuator 118*a* is of a type wherein an enclosed piston travels back and forth within a cylinder. In the disclosed embodiment, attached to the piston of the actuator 118*a* is a drive bracket 119. A second actuator 118*b* is mounted to a cross-member 117 located between upright members 18. The bracket 119 also attaches to a piston of the second actuator 118*b* to couple the two actuators 118*a* and 118*b*.

In operation, energizing the first actuator 118*a* causes the third rail members 116 to move along the second rail member 114. Upon reaching the end of travel of the first actuator 118*a*, the second actuator 118*b* is energized which continues to move on the third rail member 116. The actuators 118*a* and 118*b* move the third rail member 116 until it reaches the end of the second rail member 114, after which the second rail member 114 starts to move with respect to the first rail member 112. Accordingly, the actuators 118*a* and 118*b* are operative to move the frame 109 and correspondingly transports the carrier mechanism 56 from a position wherein the support member 58 is positioned within the lower heated platen 36 to a position wherein the support member 58 is positioned adjacent the forming die 52.

Attached to the frame 107, and specifically to the third rail member 116 of each of the extending arm members 106, is the first and second scissor lift linkage 70, 72 of the lift mechanism 68 of the carrier mechanism 56. Accordingly, the entire carrier mechanism 56, including the lift mechanism 68, travels with, and correspondingly extends outwardly with, the inner or third rail member 116. Since the scissors lift linkage 70, 72 is connected to the inner or third rail member 116, the transfer mechanism 54 operates as shown in FIG. 4B to move or extend the inner or third rail member 116 and correspondingly the lift mechanism 68 and support member 58 to a position adjacent to the press assembly 14.

Figure 4A:
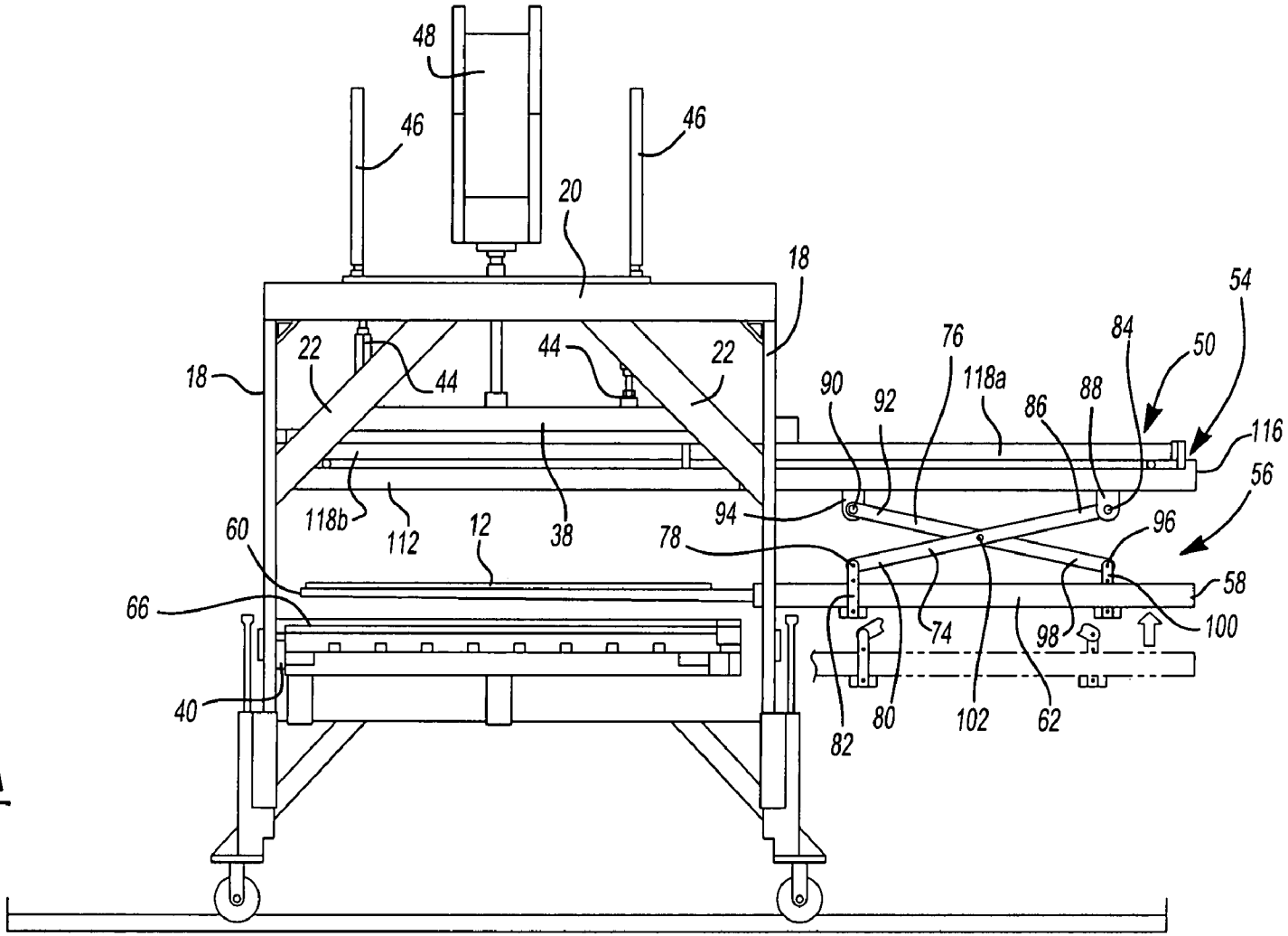
FIG. 4A is a schematic front view of the apparatus of FIG. 1 illustrating the transfer mechanism in a lifted or raised position.
Figure 4B:
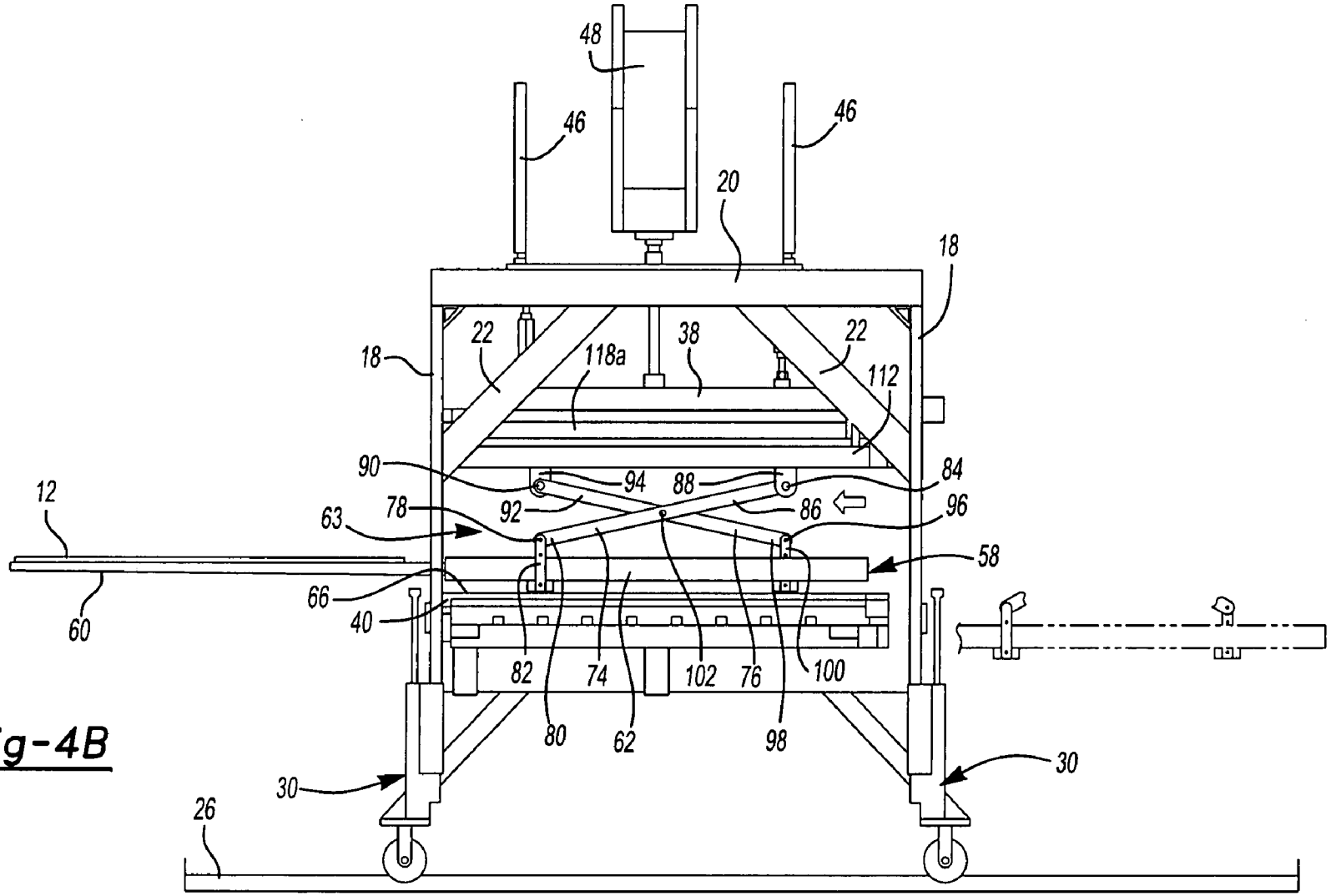
FIG. 4B is a schematic front view of the apparatus of FIG. 1 illustrating the transfer mechanism in a lifted and partially extended position.

Referring now to FIGS. 3–4B, once the workpiece 12 reaches a predetermined temperature or heats for a predetermined length of time, the upper platen 40 moves upward to reveal the workpiece 12. Energizing the lift actuator 104 lifts the support member 58 upward thereby raising the carrier mechanism 56. Raising the carrier mechanism 56 correspondingly lifts or raises the workpiece 12 off the upper surface 66 of the lower heated platen 38 using the tines 60 of the support member 58. Once the workpiece 12 is lifted a suitable distance above the upper surface 66 of the lower heated platen 38, see FIG. 4A, the actuators 118*a* and 118*b* are energized to extend the arm members 106. Extending the arm members 106 transfers the carrier mechanism 56 and correspondingly the workpiece 12 from the contact heater 36 to a position adjacent the forming die 52 located in the press assembly 14.

Figure 5A:
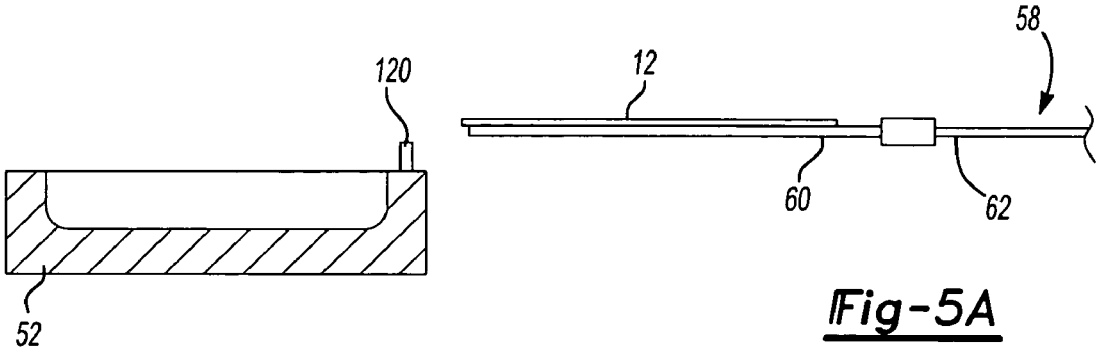
FIGS. 5A–5D are schematic side views illustrating a workpiece being deposited in a forming die utilizing an apparatus according to the present invention.
Figure 5B:
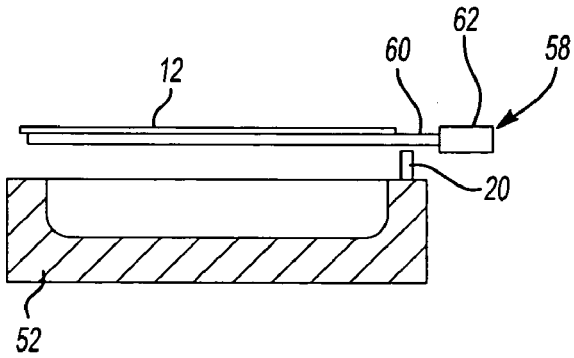
Figure 5C:
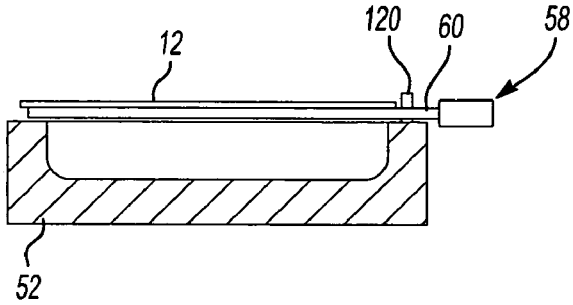
Figure 5D:
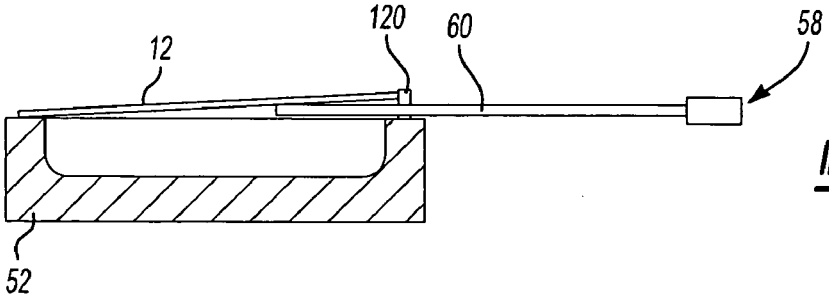

FIGS. 5A–5D show the workpiece 12 removed from the support member 58 of the apparatus 10 and deposited on the forming die 52 located in the press assembly 14. Specifically, FIG. 5B shows the workpiece 12 placed over the forming die 52 by the support member 58. FIG. 5C shows the lift mechanism 68 lowering the support member 58 and corresponding tines 60 to a position wherein an extractor pin 120, located on or adjacent the forming die 52, is positioned between the workpiece 12 and the support frame 62 of the support member 58. The transfer mechanism 54 operates to retract the arm members 106 and withdraw the support member 58. FIG. 5D shows the extractor pin 120 engaging and holding the workpiece 12 in place, such that the tines 60 of the support member 58 slide out from underneath the workpiece 12, leaving the workpiece 12 in the forming die 52.

Figure 7:
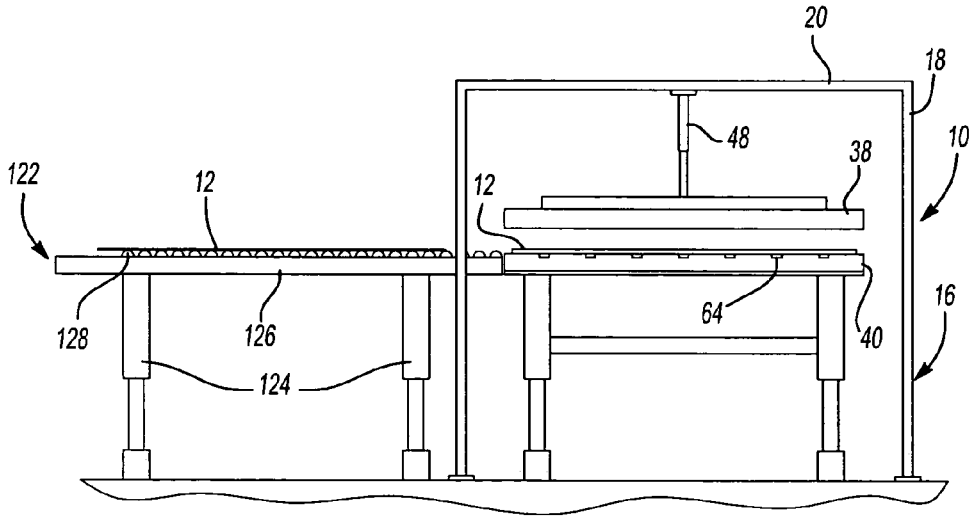
FIG. 7 is a schematic side view of a load table according to the present invention.

FIGS. 1–3 and 7 show a load table, seen generally at 122, positioned adjacent the apparatus 10. As shown in FIG. 7, the load table 122 includes a plurality of legs 124 supporting a table surface 126. As shown in FIGS. 1–3, a frame 16 attaches to and supports the load table. Both designs work equally well and are simply a matter of design choice. In each embodiment, the load table 122 has a plurality of rollers 128 located thereon. The rollers 128 allow for movement of the workpiece 12 into the contact heater 36. A load bar 130 slidably mounted to the load table 122 by rollers 132 pushes the workpiece 12 into the contact heater 36. The load bar 130 may be either manually operated or an actuator may be used to urge the workpiece 12 into the contact heater 36.

Figure 8A:
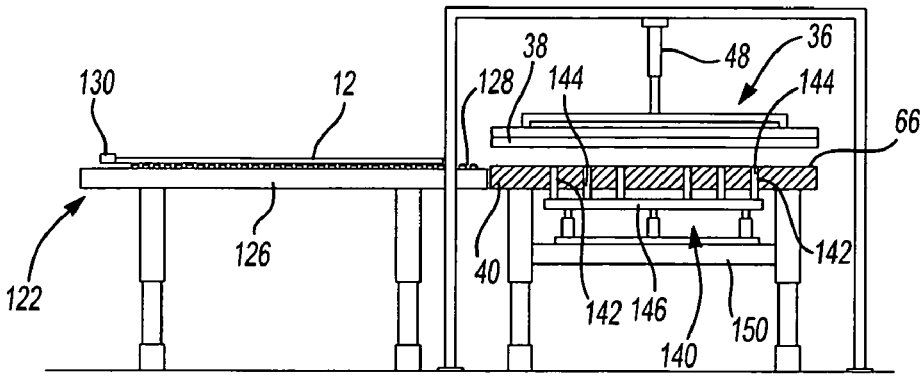
FIGS. 8A–8E are schematic side views of an alternative embodiment of the present invention.
Figure 8B:
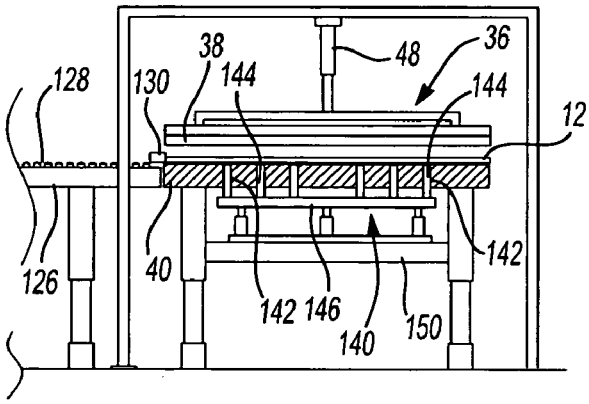
Figure 8C:
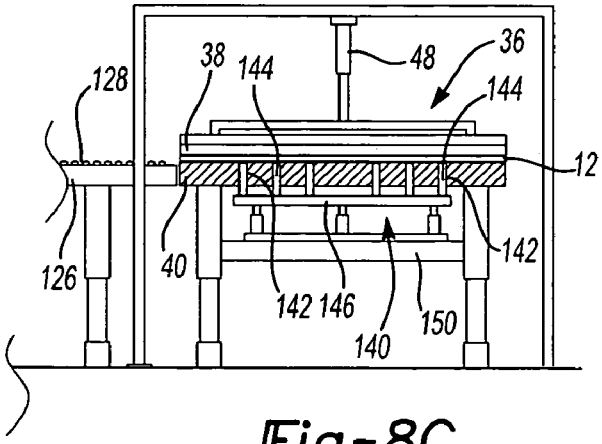
Figure 8D:
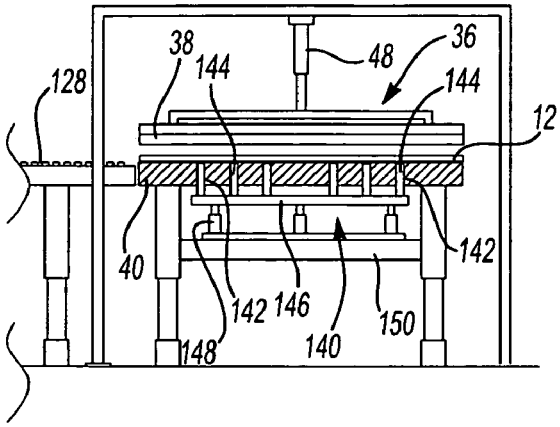
Figure 8E:
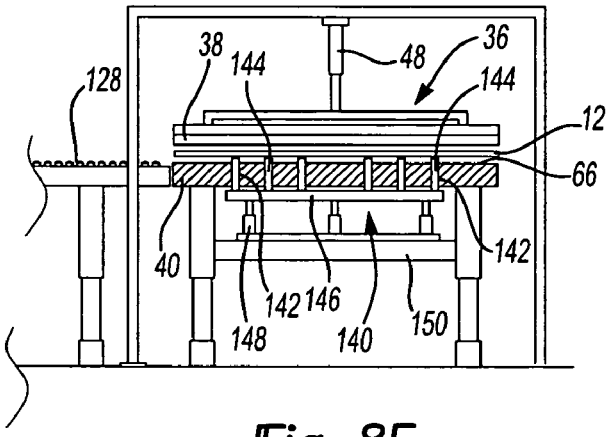

FIGS. 8A–8E illustrate an alternative embodiment according to the present invention. The embodiment includes a lift mechanism, seen generally at 140, that lifts the workpiece 12 off the upper surface 66 of the lower heated platen 40. The lower heated platen 40 has a plurality of apertures 142. A plurality of lifting pins 144 is located in the apertures 142 in the lower heated platen 40. A common support member 146 engages the lifting pins 144 whereby the lifting pins 144 all move simultaneously to engage and lift the workpiece 12 at the same time. The support member 146 is driven by a plurality of actuators 148 supported on a cross member 150 of the frame assembly 14. Thus, as shown in FIG. 8E, when the actuators 148 raise the support member 146, the support member 146 simultaneously moves all of the lifting pins 144 upward to raise the workpiece 12 off the upper surface 66 of the lower heated platen 40. Once the workpiece 12 raises or lifts off the upper surface 66 of the lower heated platen 40, the transfer mechanism 54 operates to carry the workpiece 12 from the contact heater 36 to the press assembly 14.

FIGS. 8A–8E further illustrate a method for using the embodiment shown therein. FIG. 8A shows the workpiece 12 positioned on the load table 122 at the beginning of the process. FIG. 8B shows the workpiece 12 sliding from the load table 122 into the heater assembly or contact heater 36 using the load bar 130. FIG. 8C shows the upper heated platen 38 urged downward to engage the workpiece 12 and correspondingly heat the workpiece 12 to a predetermined temperature or for a predetermined length of time. FIG. 8D shows that once the workpiece 12 reaches a predetermined temperature or heats for a suitable time, the upper heated platen 38 raises up to reveal the workpiece 12. FIG. 8E shows the lifting pins 144, raised by the actuators 148; raising the workpiece 12 above the upper surface 66 of the lower heated platen 40.

Figure 9A:
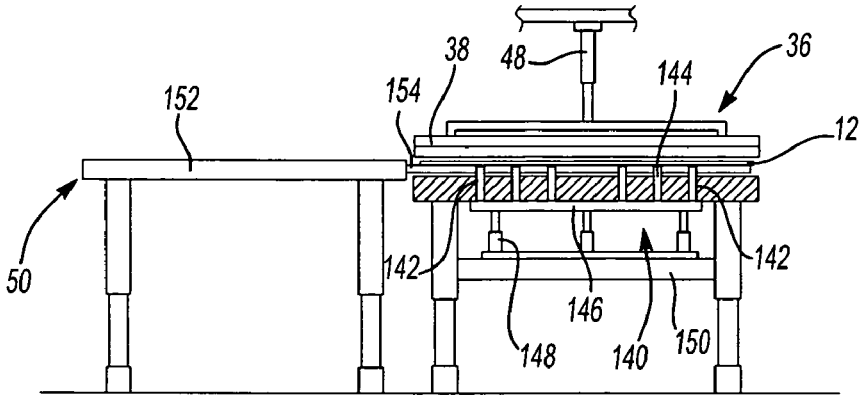
FIGS. 9A–9C are schematic front views of an alternative embodiment of a transfer mechanism according to the present invention for use with the embodiment illustrated in FIGS. 8A–8E.
Figure 9B:
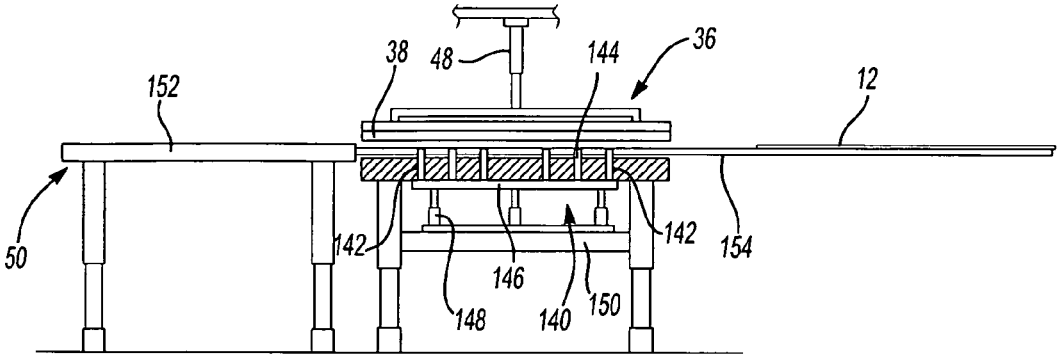
Figure 9C:
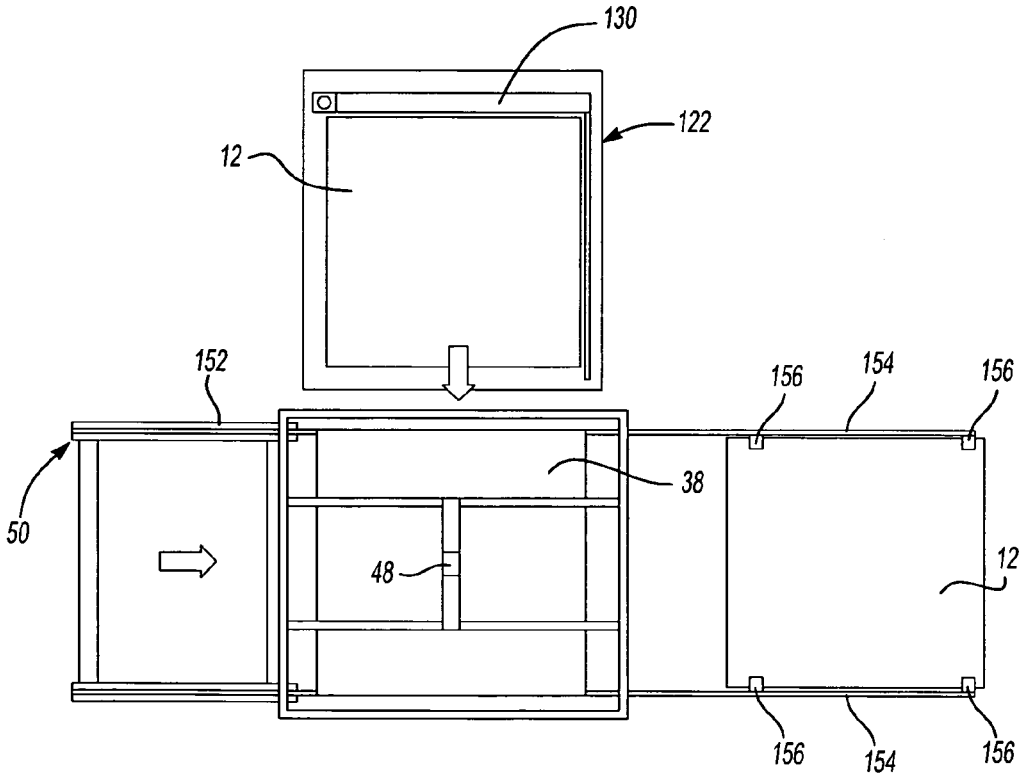

FIGS. 9A–9C illustrate an alternative embodiment of a shuttle assembly 50 wherein a transfer mechanism 152, similar to that disclosed above in that it extends and retracts, is used to transfer the workpiece 12 from the heater assembly or contact heater 36 to the press assembly 14. The transfer mechanism 152 includes extendable arm members 154. A plurality of workpiece engaging members 156 attached to the arm members 154 engage and assist in transferring the workpiece 12 from the lifting pins 144, or the particular lifting mechanism that raises the workpiece 12 off the upper surface 66 of the lower heated platen 40, to the press assembly 14. The workpiece engaging members 156 are shown extending transversely to the arm members 154. The workpiece engaging members 156 may be retractable, that is they retract in a direction transverse the arm members 154 to release or deposit the workpiece 12 on to the forming die 52. In addition, the workpiece engaging members 156 may rotate about the longitudinal axis of the arm members 154. One function of the workpiece engaging members 154 is to support the workpiece 12 while it is carried from the contact heater 36 to the forming die 52. Accordingly, the workpiece engaging members 156 may include clamping members fastened or connected to the arm members 154. The clamping members are operative to clamp the workpiece 12 between them and then release to deposit the workpiece 12 on the forming die 52.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An apparatus for heating and transferring a workpiece into a forming press for forming comprising:

a frame, said frame having a plurality of upright leg members interconnected by side support members;

a heater assembly, said heater assembly including an upper platen, said upper platen mounted for reciprocal movement on said frame, a heater unit associated with said upper platen, a lower platen, said lower platen positioned in a spaced relationship from said upper platen, a heater unit associated with said lower platen, said upper platen cooperating with said lower platen to heat the workpiece when the workpiece is placed between said upper and lower platens;

a shuttle assembly, said shuttle assembly moving between a first position adjacent said heater assembly and a second position adjacent the forming press, said shuttle assembly including a transfer mechanism and a carrier mechanism, said carrier mechanism including a support member contacting the workpiece and supporting the workpiece during movement between said heater assembly and the forming press; and said transfer mechanism including a drive assembly engaging said carrier mechanism and operative to move said carrier mechanism in a reciprocal manner between said heater assembly and said forming press.

2. An apparatus as set forth in claim 1 wherein said apparatus includes:

said lower platen having an upper surface, a plurality of channels located in said upper surface;

said support member including a plurality of members forming a lifting platform to support the workpiece, said lifting platform disposed within said channels such that said lifting platform is positioned below said upper surface of said lower platen; and a lift mechanism, said lift mechanism connected to and operative to raise and lower said support member.

3. An apparatus as set forth in claim 2 wherein said lifting platform includes a plurality of outwardly extending fingers, each of said fingers disposed within said channels located in said upper surface of said lower platen.

4. An apparatus as set forth in claim 1 wherein said apparatus includes:

said lower platen having a plurality of apertures located therein;

a plurality of lift pins located in said apertures, said lift pins movable between a first, lower position wherein said pins are below an upper surface of said lower platen and a second, raised position wherein said pins extend above said upper surface of said lower platen; and an actuator, said actuator operative to move said lift pins between said first lower position and said second raised position.

5. An apparatus as set forth in claim 1 wherein said transfer mechanism includes an arm member, said arm member connected to said support member wherein said drive assembly is operative to move said arm member between a first extended position and a second retracted position.

6. An apparatus as set forth in claim 1, wherein said transfer mechanism includes an extendable arm, said extendable arm having a plurality of arm members disposed in a telescopic relationship; and said drive assembly including an actuator engaging at least one of said plurality of arm members, said actuator operative to extend and retract said extendable arm.

7. An apparatus as set forth in claim 6 wherein said plurality of arm members disposed in a telescopic relationship include a plurality of elongated rail members slidably supported on one another by a plurality of roller members.

8. An apparatus as set forth in claim 1 wherein said shuttle assembly includes a lift mechanism, said lift mechanism connected to said carrier mechanism and operative to raise and lower said support member.

9. An apparatus as set forth in claim 1 wherein said shuttle assembly includes a lift mechanism, said lift mechanism connected to said carrier mechanism and operative to position said support member in a plurality of positions including a base position wherein said support member is spaced from an upper surface of said lower platen, a transfer position wherein said carrier mechanism lifts the workpiece from said heater assembly and transfers the workpiece to said press and a deposit position wherein the workpiece is deposited in the press.

10. An apparatus as set forth in claim 1 wherein said apparatus includes an extractor pin associated with a forming die located in the forming press, said extractor pin cooperating with said support member to remove the workpiece from the support member.

11. An apparatus as set forth in claim 9 wherein said lift mechanism includes first and second link members, said first and second link members pivotally connected in a scissors configuration;

a first end of said first and second link members slidably secured in a base member and the second, opposite end slidably secured to said transfer mechanism; and an actuator, said actuator connected between said transfer mechanism and said support member.

12. An apparatus as set forth in claim 9 wherein said lift mechanism includes a pneumatic cylinder.

13. An apparatus as set forth in claim 1 including a loading table, said loading table positioned adjacent to said heater assembly.

14. An apparatus as set forth in claim 1 wherein said carrier mechanism includes:

first and second longitudinally extending arm members;

each of said arm members having at least one support member located on each of said arm members, said support members moveable between a first carry position and a second deposit position.

15. An apparatus for loading a heated workpiece into a forming press comprising:

a frame;

a heated lower platen, said lower platen having an upper surface, a plurality of channels located in said upper surface of said lower platen;

a heated upper platen secured to said frame above said lower heated platen for reciprocal motion, wherein the workpiece is positioned between the upper and lower heated platens for heating to a suitable forming temperature;

a support member including a plurality of longitudinally extending members forming a lifting platform to support the workpiece, said lifting platform disposed within said channels such that said lifting platform is positioned below said upper surface of said lower platen;

an extendable arm to connected to said support member, said extendable arm having a plurality of arm members disposed in a telescopic relationship;

an actuator engaging at least one of said plurality of arm members, said actuator operative to extend and retract said extendable arm; and a lift mechanism connected to said extendable arm and operative to position said support member in a plurality of positions.

16. An apparatus as set forth in claim 15 wherein said lift mechanism includes:

first and second link members, said first and second link members pivotally connected in a scissors configuration;

first ends of said first and second pivotally connected link members slidably secured to said support member and the second, opposite ends of said first and second link members slidably secured to said extendable arm; and an actuator connected between said support member and said extendable arm, said actuator operative to raise and lower said support member with respect to said extendable arm.

17. A method of transferring a workpiece from a heater to a press used for forming a workpiece comprising the steps of:

providing a heater assembly for heating the workpiece prior to placing the workpiece in the press, said heater assembly including a lower platen having an upper surface;

placing said workpiece on said upper surface of said lower platen and heating said workpiece;

providing a support member, placing the support member under the workpiece;

lifting the workpiece on the support member;

carrying the workpiece from the heater assembly to the press; and retracting the support member and depositing the workpiece in said press.

18. A method of transferring a workpiece from a heater to a press as set forth in claim 17 wherein the step of placing the support member under the workpiece includes the step of placing the support member in a plurality of channels located in the upper surface of the lower platen wherein the support member is positioned below the upper surface of the lower platen.

19. A method of transferring a workpiece from a heater to a press as set forth in claim 17 wherein the step of retracting the support member and depositing the workpiece in said press includes the step of providing an extractor member associated with the press;

transferring the support member and correspondingly the workpiece over and past the extractor member;

lowering the workpiece until an edge of the workpiece is adjacent the extractor member; and withdrawing the support member such that the workpiece engages the extractor member whereby the workpiece remains stationary and the support member is withdrawn from underneath the workpiece.

20. A method of transferring a workpiece from a heater to a press as set forth in claim 17 including using a lift mechanism for lifting the workpiece off of the upper surface of the lower platen prior to placing the support member under the workpiece.

* * * * *